United States Patent [19]

Norton

[11] 4,263,983

[45] Apr. 28, 1981

[54] SINGLE STILE LADDER

[75] Inventor: Don S. Norton, Clinton, Miss.

[73] Assignee: Don Norton Manufacturing Co., Inc., Clinton, Mich.

[21] Appl. No.: 30,935

[22] Filed: Apr. 17, 1979

[51] Int. Cl.[3] ..... E06C 1/34

[52] U.S. Cl. ..... 182/93; 182/100; 182/178; 182/189

[58] Field of Search ..... 182/100, 178, 189, 194, 182/93

[56] References Cited

U.S. PATENT DOCUMENTS

| | | | |
|---|---|---|---|
| 414,686 | 11/1889 | Dinn | 182/189 |
| 591,418 | 10/1897 | La Verne et al. | 182/189 |
| 2,744,674 | 5/1956 | Smith | 182/178 |
| 2,957,538 | 10/1960 | Pottmeyer | 182/189 |
| 3,995,714 | 12/1976 | Brookes | 182/100 |
| 4,061,202 | 12/1977 | Campbell | 182/100 |
| 4,069,892 | 1/1978 | Lynne | 182/189 |

FOREIGN PATENT DOCUMENTS

| | | | |
|---|---|---|---|
| 926633 | 4/1955 | Fed. Rep. of Germany | 182/206 |
| 3455 | of 1878 | United Kingdom | 182/100 |

*Primary Examiner*—Reinaldo P. Machado
*Attorney, Agent, or Firm*—Larry S. Nixon

[57] ABSTRACT

A portable, multisectional ladder for scaling poles, trees and like objects and a method of use thereof. Individual ladder sections are formed of steps welded to individual angle metal sections. The angle metal sections are removably joined using male/female connectors at either end thereof. One or more brackets welded to each section slidably retains an auto-type safety belt which can be releasably buckled about the object to be scaled. The brackets on each section except for the base section include a special belt cincher arrangement which includes means for drawing the belt into the recessed portion of the angle metal to forcibly tighten the belt about the object to be climbed, thereby eliminating any slippage or wobble in the ladder.

19 Claims, 7 Drawing Figures

Fig. 3.
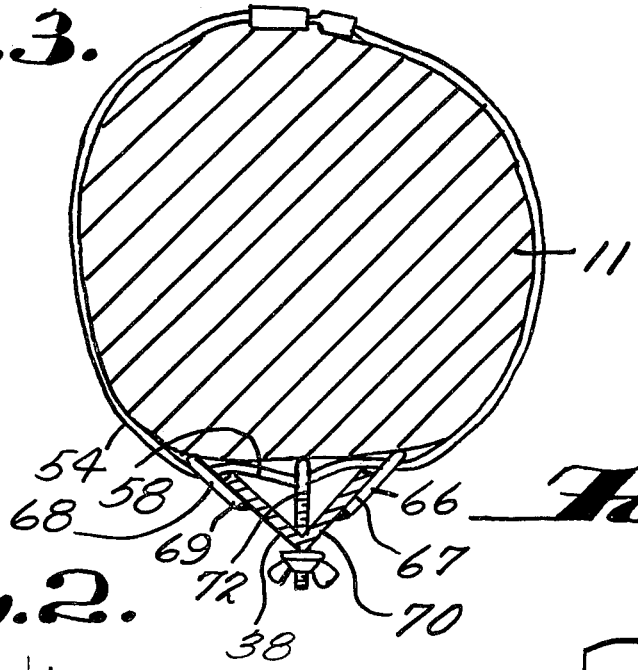
Fig. 4.
Fig. 2.
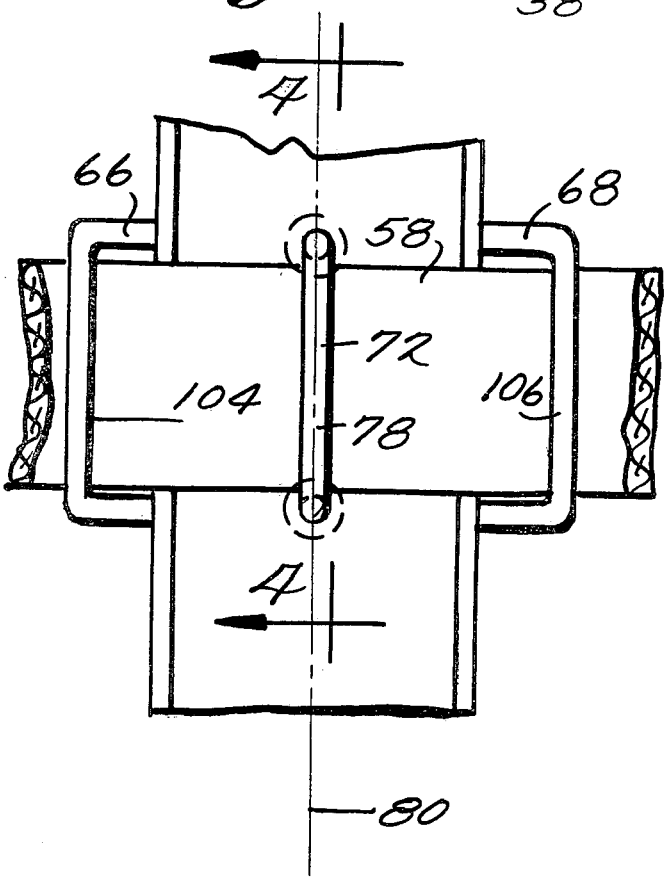
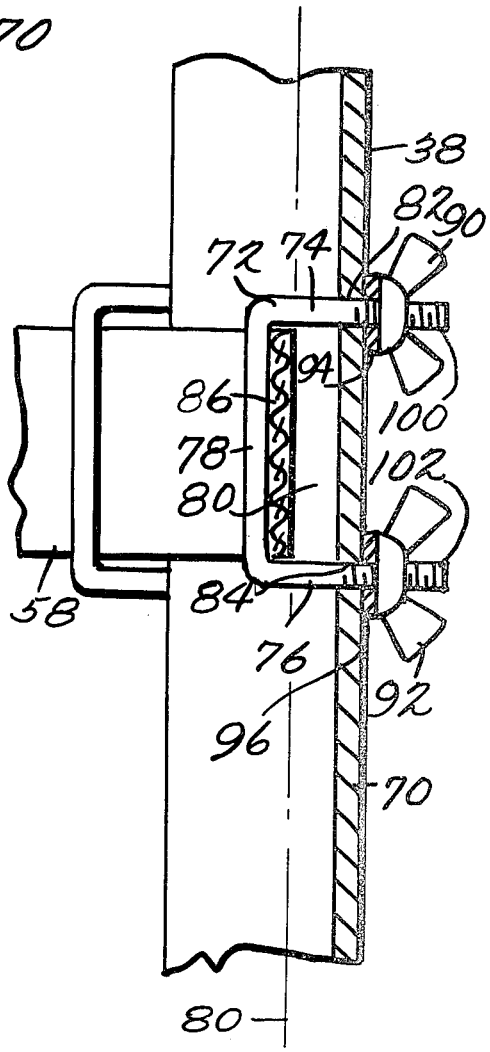

SINGLE STILE LADDER

BACKGROUND OF THE INVENTION

This invention relates to multisectional ladders and more particularly to a portable lightweight ladder which is attachable to a pole, tree or the like to facilitate the scaling thereof. The invention also relates to a method of scaling a pole, tree or the like utilizing such a ladder.

Scaling of poles, trees and the like is a problem encountered by many persons in their work and leisure. Linemen, for example, are often required to scale utility poles to repair telephone and power lines and hunters often scale trees to a tree stand. For such persons, speed, convenience and safety are all important features of any apparatus or method for scaling poles and trees. Particularly for linemen, the presently preferred method of climbing utility poles are leg irons. However, the use of leg irons requires a great deal of strength and skill and many injuries have resulted from their incorrect use.

In order to overcome the problem in scaling poles, lightweight portable ladders have been developed. For example, U.S. Pat. No. 3,995,714 issued to Brooks et al, discloses a multisectional ladder particularly adapted for scaling utility poles. The top section of the ladder includes a vertical spar at the top of which a crook-shaped arm and a yoke are hingedly mounted to form a tiltable harness which grips the pole. Y-shaped stabilizers project from the bottom of each section to support the sections at a uniform distance from the pole, the bottom section being supported completely off of the ground. The ground surrounding the pole plays no part in supporting the ladder. Adjustable straps spaced along the ladder are used for purposes of security.

The ladder disclosed by Brooks et al has limited flexibility in terms of the diameter and form of poles it may be used to scale due to the fixed angles and curves of the yokes and crook-shaped arm used to support the ladder. The ladder would also not be very useful for scaling most trees because branches of the tree could interfere with the raising of the crook-arm to the desired height. The ladder also has rather complex construction including a precision hinged open loop assembly including a bladec crook-arm, serrated yokes, and means for coupling the yokes and loop assembly to the spar. Also such a ladder has many parts extending from each spar making the ladder relatively cumbersome to carry or store.

It is an object of the present invention to overcome these and other disadvantages of prior portable multisectional ladders by providing a sturdy, lightweight, portable, multisection ladder which is compact for carrying and storage and permits one to quickly and safely scale any pole, tree or the like, and a method for using same.

BRIEF SUMMARY OF THE INVENTION

In accordance with the present invention, there is provided a portable multisection ladder including a base section and at least one extension section, each section including an elongated V-shaped metal member, transversely mounted steps and special means for securely fastening the ladder sections vertically end-to-end to a pole, tree or similar object to be climbed.

Each extension member may be attached end-to-end to the top end of the base member or to other extension members using a male/female plug type arrangement. When mounted to the object to be scaled, the inside of the "V" of the elongated members will face the object surface. At least one strap including quick-release type auto seat belt-type buckles engages each elongated member and is adapted to wrap around the object in order to fasten the member thereto. Brackets are provided with each extension section for slidably engaging the corresponding straps. Each such bracket includes a special belt cinching arrangement which permits the strap to be forceably tightened by drawing it into the recessed "V" section of the extension section's elongated metal member. The elongated members, brackets and steps may all be made of simple inexpensive lightweight parts.

In accordance with the method of the present invention, the ladder sections are first joined end-to-end and the ladder placed vertically at the base of the object to be climbed. The climber then leans on the first two steps of the ladder to set the ladder base to the object and secures the base section straps to the object. The climber then steps on the first two steps of the ladder and secures the base section straps around the object. The extension section straps of the first extension section are then secured around the object. Next, these straps are tightened with the cinching arrangement. If more than one extension section is being used, the climber merely steps up further up the ladder and secures and cinches the corresponding straps of the additional ladder sections. With the arrangement of the present invention, it is possible for a hunter or lineman to scale poles and trees having a range of diameters in a manner which is quick and which is safer, more convenient and less expensive than was possible with prior devices.

SUMMARY OF THE DRAWINGS

Other objects, features and advantages will be apparent from the following detailed description of the preferred embodiment of the invention and the appended drawings in which:

FIG. 2 is a fragmentary rear elevation view of the cincher arrangement of the present invention;

FIG. 3 is an enlarged cross sectional view taken along the line 3—3 of FIG. 1;

FIG. 4 is an enlarged sectional side elevation of the cincher arrangement shown in FIGS. 1, 2 and 3 taken along the line 4—4 in FIG. 1;

DETAILED DESCRIPTION OF THE PREFERRED EMBODIMENT

Figure 1:
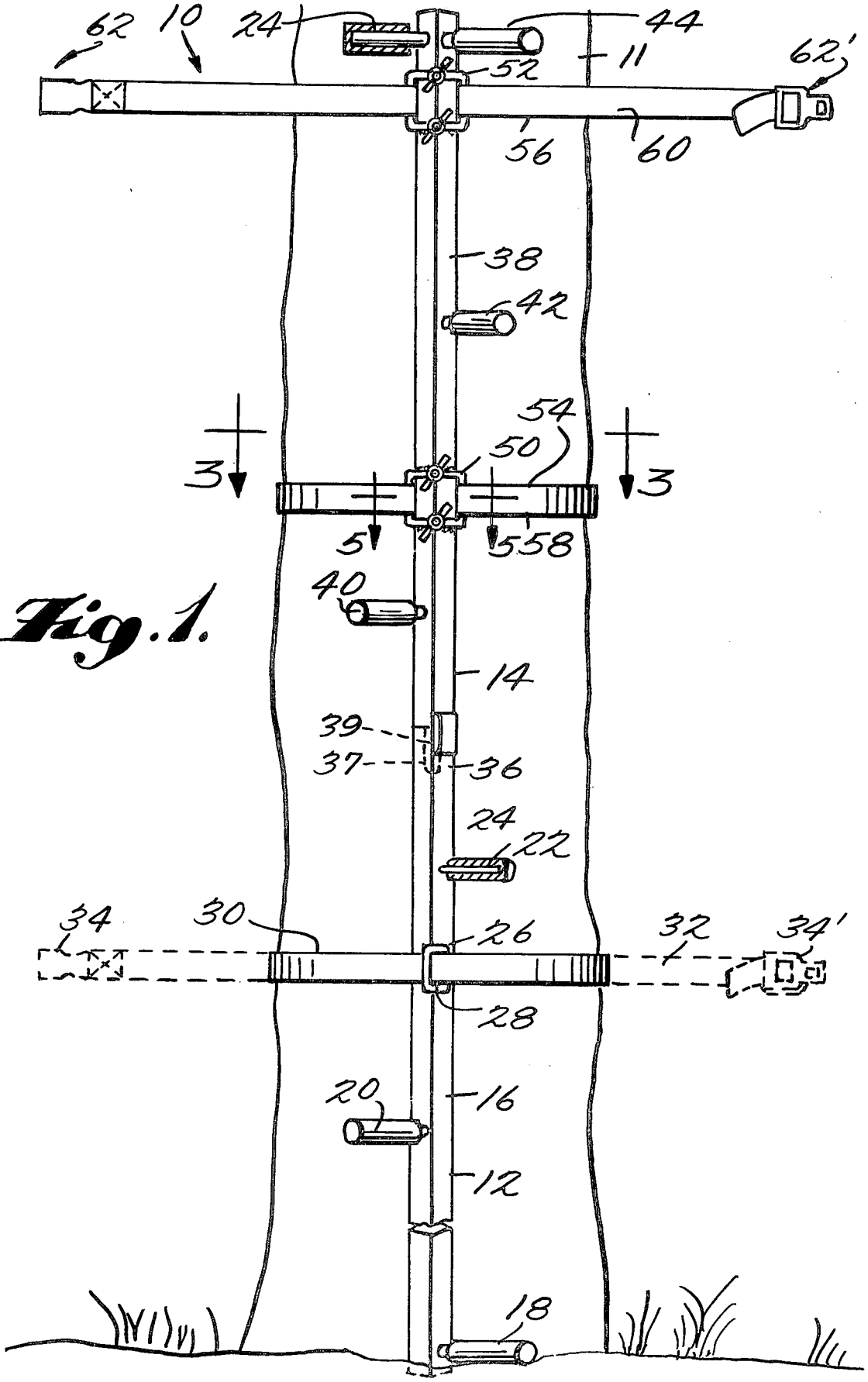
FIG. 1 is a front elevation of the ladder of the present invention shown partially strapped to a tree.

Referring first to FIG. 1, there is shown a climbing stick generally identified by the numeral 10 partially mounted to a tree 11 in accordance with the present invention. The climbing stick 10 illustrated in FIG. 1 includes a base section 12 and an extension section 14 mounted end-to-end to base section 12. For purposes of illustration only one extension section 14 is shown. However, additional extension sections 14 may be mounted vertically one above another to form a ladder of the desired length. Base section 12 includes an elongated member 16 having a V-shaped transverse cross section. Member 16 is suitably composed of a strong, lightweight metal such as aluminum. Steps 18, 20 and 22 are mounted as by welding to member 16. Rubber covers 24 may be mounted on the steps to provide sure footing for the user. A single bracket 26 is mounted as by welding to member 16 in order to provide a fixed loop 28. In order that base member 12 may be strapped to tree 11, an auto seat belt-type strap 30, including web 32 and quick release buckle 34, 34', slidable engages the member 16 through the loop 28 formed by bracket 26 and member 16. A quick release-type buckle 34 permits the base section 12 to be quickly secured to or released from the tree 11. The upper end 36 of member 16 includes the female portion 37 of a male/female type connector for connecting base section 12 to extension section 14 with their respective longitudinal axis aligned. Extension section 14 includes an extended member 38, also having a V-shaped cross section, and has a male portion 39 of a female/male connector for connecting to the base section 12 as has been described. Extension section 14 also includes steps such as steps 40, 42 and 44 which are mounted as by welding to extended member 38.

Mounted to extended member 38 are bracket assemblies 50 and 52 which slidably engage straps 54 and 56. Straps 54 and 56 may be wrapped around tree 11 to secure extension assembly 14 vertically thereto. Straps 54 and 56 are automobile seat belt-type straps respectively including webs 58 and 60 and quick release buckles such as buckle 62-62' which permit straps 54 and 56 to be quickly and easily secured to or released from tree 11.

Figure 5:
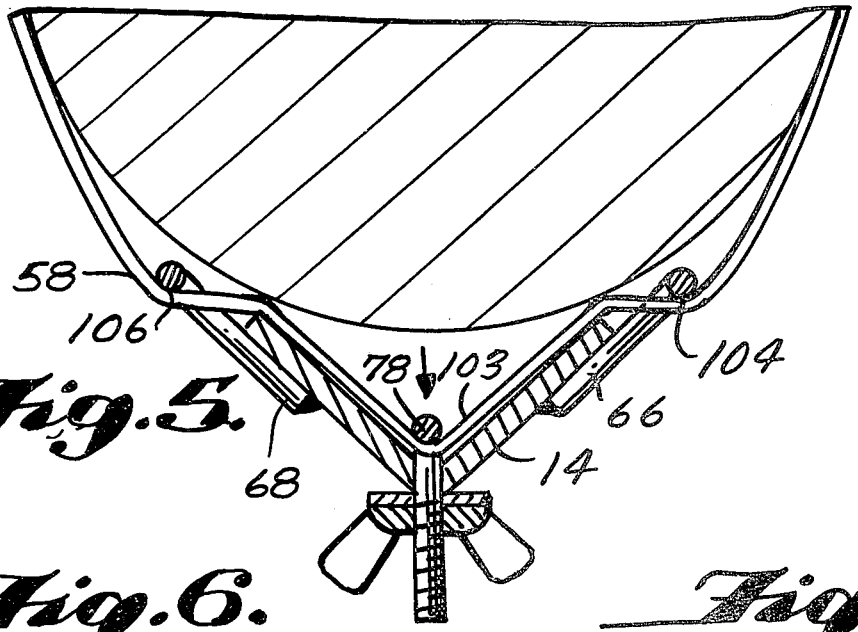
FIG. 5 is a cross sectional view taken along the line 5—5 in FIG. 1 showing the cincher arrangement drawing the web tightly about the tree.

Bracket assemblies 50 and 52 are suitably identical in construction and may be best described with reference to FIGS. 2, 3 and 4 which respectively show rear, sectional top and sectional side views of bracket assembly 50. Referring first to FIGS. 2 and 3 there are shown U-shaped support brackets 66 and 68 respectively mounted to extended member front surfaces 67 and 69 so that web 58 of strap 54 may slidably engage brackets 66 and 68 in nominal spaced relation with rear surface 70 of extended member 38. As is illustrated in FIG. 4, a U-shaped bracket 72 having legs 74 and 76 and middle portion 78 is mounted to extended member 38 with its legs 74 and 76 vertically aligned along the longitudinal axis 80 of the rear surface 70 of elongated member 38 so that webbing 58 may pass inside the inside surface 86 of the center portion 78 of bracket 72 in nominal spaced relation with extended member rear surface 70. The respective legs of bracket 72 pass through vertically aligned holes 82 and 84 in extended member 38. Wing nuts 90 and 92 and washers 94 and 96 engage the threaded ends 100 and 102 of legs 74 and 76 to draw webbing 58 toward longitudinal axis 80 in rear surface 70 of extended member 38. Referring to FIG. 5, it will be observed that by drawing a portion 103 of web 58 located between U-shaped support bracket middle portions 104 and 106, the entire extended section 14 is substantially tightened to tree 11. Alternate cinching means may also be utilized.

A significant feature of the present invention is the drawing of the strap webbing away from the tree so as to tighten the extended portion thereto. Means other than those described in detail herein for accomplishing this result are fully contemplated as falling within the scope of the present invention. For example, extended member 38 may be replaced by a U-channel shaped structure or other structure which slidably engages the webbing 58 and includes a means for drawing the webbing away from the tree and holding it in that tightened position.

Figure 6:
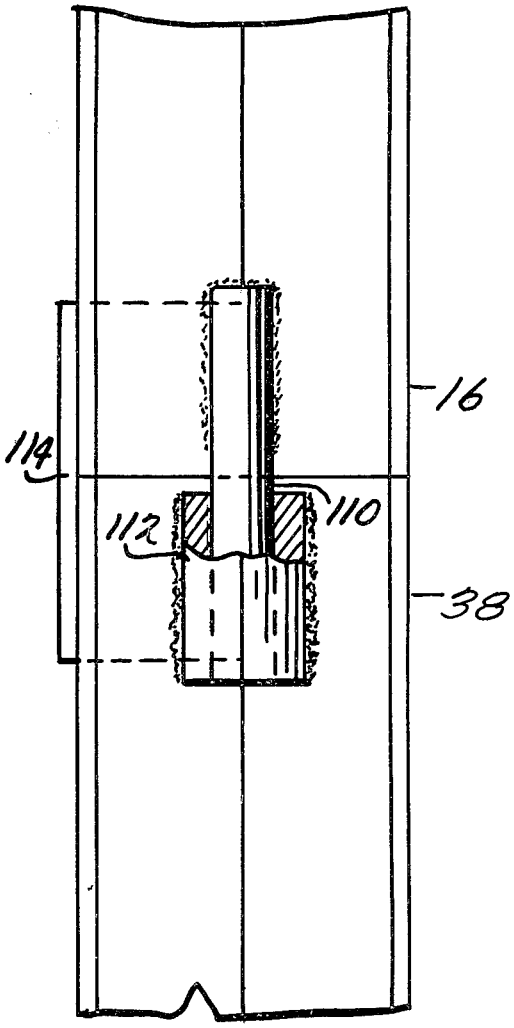
FIG. 6 is an enlarged rear elevation fragmentary view of the section connector portion of the present invention.
Figure 7:
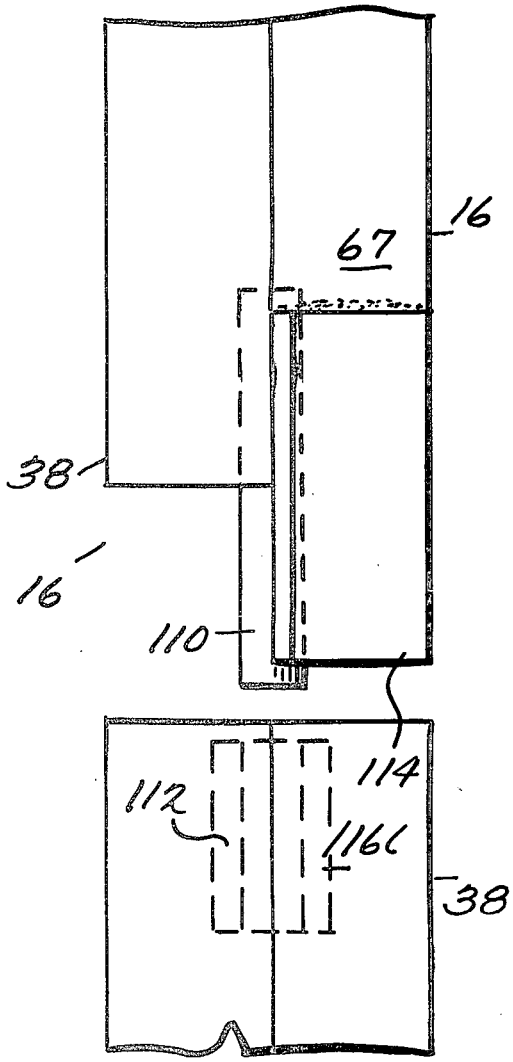
FIG. 7 is an enlarged front elevation of the connector portion shown in FIG. 1 with the two sections apart.

FIGS. 6 and 7 illustrate the locking mechanism by which any two sections of the ladder may be connected. Referring to FIG. 6, a prong 110 extending from the bottom end of extended member 38 is inserted in the receiving bracket 112 mounted to the rear upper surface of base extended member 16. A spring mounted plate like member 114 extends downward from the front face 67 of extended member 38 to engage the top surface 116 of extended member 16 to keep the two extended member in sturdy axial alignment. FIG. 7 shows the connective portions of extended members 16 and 38 when they are disengaged.

In accordance with the method of the present invention and in order to properly utilize the above described multisectional ladder to scale a pole, tree or like object, the base section 16 and one or more extension sections such as extension section 38 are axially mounted end-to-end. The complete ladder 10 is then positioned upright against the object to be climbed with the base section at the object's base. Then, while leaning against one or more of the bottom steps 18 and 20 of the ladder 10, strap 30 is secured about the base of the object, tightening by pulling on the free end of the webbing 32 and then exerting a substantial force downward on the base section as by putting one's full weight on the first one or two steps 18 and 20 of the base section. The next stage in mounting the ladder to the object to be scaled is to step up to step 22 and fasten strap 54 about the object to be scaled in the same manner as was utilized with respect to strap 30. In order to eliminate any slippage or wobble of the ladder, the wing nuts 90 and 92 are tightened, drawing U-bracket 72 and web portion 103 into the recessed "V" section of the extended member 38 and forcibly tightening the strap 54. These last two steps are then repeated for strap 56 and cincher mechanism 50 to complete the mounting of the ladder. Of course, if additional ladder extension sections are utilized the climber may continue to climb the ladder and mount the additional extension sections in a like manner.

It will be understood that the present description is an illustrative embodiment of the method and apparatus of the present invention and the invention is not limited to the specific form shown. Many modifications in the design and arrangement of the elements will be apparent to those skilled in the art without departing from the scope of the invention as expressed in the appended claims.

What is claimed is:

1. A portable multisection ladder for scaing a pole, tree or like object comprising:

(a) a plurality of sections including a base section and at least one extension section;

(b) said base section including a first elongated member having a first longitudinal axis, at least one step fixedly mounted to said first elongated member transversely to said first longitudinal axis, and first means, including at least one first web engaging said first elongated member, for securing said first elongated member upright at the base of the object to be scaled;

(c) each said at least one extension section including a second elongated member having a second longitudinal axis, and second means, including at least one second web slidably engaging said second elongated member, for securing said second elongated member upright to said object;

(d) said at least one second web having two free ends;

(e) said second member securing means including (1) means for slidably engaging said at least one second web to said second elongated member, (2) means mounted to said second web free ends, for joining said two free ends of said at least one second web and tightening said second web around said object, and (3) means, interposable between said object and a segment of said at least one second web, for drawing and holding said segment away from said object to tighten said web about said object and tighten said second member to said object; and (f) each of said plurality of sections being mountable to one another end-to-end such that said first longitudinal axis is aligned with the second longitudinal axis of said second elongated member of said each at least one extension section.

2. A ladder as in claim 1 wherein:

said at least one second web slidably engages said second elongated member in nominally spaced relation therewith, said web segment and said second elongated member defining a nominal space therebetween such that when said at least one second web surrounds said object, said web segment is disposed between said object and said second elongated member; and said interposable means includes means for engaging said segment to dray said segment into said space.

3. A ladder as in claim 2 wherein:

said second elongated member includes an inside surface and an outside surface and includes two edges, said web segment being in confronting relation with said inside surface and at an outer boundary of said nominal space engaging said edges; and said at least one extension section further including actuation means, disposed at said outside surface, for causing said interposable means to draw said segment into said nominal space.

4. A ladder as in claim 3 wherein said second elongated member comprises a V-shaped angle metal and said drawing means includes a U-shaped bracket having two vertical legs and a central leg for engaging said web portion at its central leg and actuation means, disposed at the outside surface of said metal, for drawing the vertical legs of said bracket through said metal to pull said central leg and said web portion toward said inside surface.

5. A ladder as in claim 1 wherein said first and second member securing means each include an auto-type safety belt including a quick release buckle for releasably buckling said first and second webs about said object.

6. A portable, multisection ladder for scaling a pole, tree or similar object comprising:

a plurality of sections including a base section and at least one extension section;

said base section including a base elongated member having a longitudinal axis, at least one step mounted on said base elongated member transverse to said longitudinal axis, and first means, including a first web engaging said base elongated member, for tying said base elongated member to the base of the object to be scaled;

said at least one extension section each including an extension elongated member having a longitudinal axis, an inside surface, an outside surface, and two spaced apart edges generally parallel to said longitudinal axis, and at least one step mounted on said extension elongated member transverse to said longitudinal axis;

at least one of said at least one extension section including second means, including a second web slidably engaging said extension elongated member along said two edges, for tying said extension elongated member vertically to the object to be scaled above said base elongated member, said inside surface being in confronting relationship with said object such that the portion of said second web located between said two edges is nominally spaced from said extension elongated member; and means, actuatable at the outside surface of said extension elongated member and engaging said extension elongated member and said web portion, for drawing said web portion toward said object to tighten said second web about said object and tighten said extension elongated member to said object;

each of said plurality of sections being mountable to one another end-to-end.

7. A ladder as in claim 4 wherein each said extension elongated member comprises a V-shaped angle metal and said drawing means includes a U-shaped bracket having two vertical legs and a central leg for engaging said web portion at said central leg and actuation means, disposed at the outside surface of said metal, for drawing the vertical legs of said bracket through said metal to pull said central leg and said web portion toward said inside surface.

8. A ladder as in or claim 4 wherein said first and second tying means each include an auto-type safety belt including a quick release buckle for releasably buckling said first and second webs about said object.

9. A ladder as in claim 6 further comprising male/-female connectors at opposite ends of said elongated members.

10. A ladder as in claim 5 wherein said two vertical legs are threaded and said actuation means includes a pair of wing nuts adapted to engage said vertical leg threads.

11. A method for scaling a pole, tree or other object fixed on a base, the object to be scaled having a longitudinal axis, utilizing a portable multisection including a plurality of sections including a base section and at least one extension section; said base section including a first elongated member having a first longitudinal axis, at least one step fixedly mounted to said first elongated member transversely to said first longitudinal axis, and first web means, including at least one web engaging said first elongated member, for securing said first elongated member upright at the base of said pole; each said at least one extension secton including a second elongated member having a second longitudinal axis, at least one step fixedly mounted to said elongated member transversely to said second longitudinal axis; second member securing means, including at least one second web slidably engaging said second elongated member, for tying said second elongated member upright to said pole; said second member securing means including means for slidably engaging said at least one second web to said second elongated member and means, interposable between said pole and a segment of said at least one second web, for drawing and holding said segment away from said pole to tighten said web about said pole and tighten said second member to said pole; said method comprising the stages of:

(1) positioning said base section on said base upright against said pole;

(2) surrounding said object with said first web means at least one web and securing said first elongated member upright at the base of said object;

(3) mounting one of said at least one extension segments to said base section end-to-end such that their corresponding elongated member longitudinal axes are aligned;

(4) after stage (3), surrounding said pole with said second web means at least one web and securing said second elongated member upright to said object; and (5) drawing and holding said web segment away from said pole to tighten said at least one second web about said object.

12. A method for scaling a pole, tree or other like object as in claim 9 further comprising the stages of:

concurrently with said stage of securing said first elongated member, pushing said base section against said object as by leaning against one or more of the base section steps of said ladder;

after said stage of securing said first elongated member, exerting a substantial force downward on said base section as by stepping on at least one of said at least one base section steps so that said base section is firmly supported by said base; and stepping onto higher ones of said steps as may be necessary to perform stages (3), (4) and (5).

13. A portable ladder for scaling a pole, tree or like object comprising:

an elongated member having an upper portion, a lower portion and a longitudinal axis;

at least one step fixedly mounted to said first elongated member transversely to said longitudinal axis;

means, including at least one first web engaging said elongated member at said bottom portion, for securing said elongated member upright at the base of the object to be scaled;

means, including at least one second web slidably engaging said elongated member at said upper portion, for securing said elongated member upright to said object;

said at least one second web having two free ends;

said elongated member securing means including (1) means for slidably engaging said at least one second web to said elongated member at said upper portion, (2) means mounted to said second web free ends, for joining said two free ends of said at least one second web and tightening said second web around said object, and (3) means, interposable between said object and a segment of said at least one second web, for drawing and holding said segment away from said object to tighten said web about said object and tighten said second member to said object.

14. A ladder as in claim 11 wherein:

said at least one second web slidably engages said elongated member in nominally spaced relation therewith, said web segment and said elongated member defining a nominal space therebetween such that when said second web surrounds said object, said web segment is disposed between said object and said elongated member; and said interposable means includes means for engaging said segment to draw said segment into said space.

15. A ladder as in claim 12 wherein:

said elongated member includes an inside surface and includes two edges, said web segment being in confronting relation with said inside surface and engaging said edges at an outer boundary of said nominal space; and said ladder further including actuation means, disposed at said outside surface, for causing said interposable means to draw said segment into said nominal space.

16. A portable ladder for scaling a pole, tree or similar object comprising:

an elongated member having an upper portion, a lower portion and a longitudinal axis;

at least one step mounted to said elongated member transversely to said longitudinal axis;

first means, including a first web engaging said elongated member at said lower portion, for tying said elongated member to the base of the object to be scaled;

said elongated member having at said upper portion an inside surface, an outside surface, and two spaced apart edges generally parallel to said longitudinal axis;

second means, including a second web slidably engaging said elongated member at said upper portion along said two edges, for tying said elongated member vertically to the object to be scaled, said inside surface being in confronting relationship with said object such that the portion of said second web located between said two edges is nominally spaced from said elongated member; and means, actuatable at said outside surface and engaging said extension member and said web portion, for drawing said web portion toward said object to tighten said second web about said object and tighten said elongated member to said object.

17. A ladder as in claim 14 wherein said extension elongated member comprises a V-shaped angle metal and said drawing means includes a U-shaped bracket having two vertical legs and a central leg for engaging said web portion at said central leg, and actuation means, disposed at the outside surface of said metal, for drawing the vertical legs of said bracket through said metal to pull said central leg and said web portion toward said inside surface.

18. A ladder as in claim 14 wherein said first and second tying means each include an auto-type safety belt including a quick release buckle for releasably buckling said first and second webs about said object.

19. A ladder as in claim 15 wherein said two vertical legs are threaded and said actuation means includes a pair of wing nuts adapted to engage said vertical leg threads.

* * * * *